US005228674A

United States Patent [19]

Holmes

[11] Patent Number: 5,228,674

[45] Date of Patent: * Jul. 20, 1993

[54] SHEET FEEDING APPARATUS

[75] Inventor: John H. Holmes, Owings Mills, Md.

[73] Assignee: Prime Technology, Inc., Sparks, Md.

[ * ] Notice: The portion of the term of this patent subsequent to Sep. 17, 2008 has been disclaimed.

[21] Appl. No.: 702,078

[22] Filed: May 17, 1991

Related U.S. Application Data

[63] Continuation of Ser. No. 477,155, Feb. 8, 1990, Pat. No. 5,048,812, which is a continuation of Ser. No. 266,465, Nov. 3, 1988, abandoned.

[51] Int. Cl.[5] ..... B65H 3/10

[52] U.S. Cl. ..... 271/11; 271/112; 271/114

[58] Field of Search ..... 271/10, 11, 112, 114, 271/118, 270

[56] References Cited

U.S. PATENT DOCUMENTS 4,494,745 1/1985 Ward ..... 271/35

4,614,335 9/1986 Sardella ..... 271/118 X

*Primary Examiner*—Richard A. Schacher

*Attorney, Agent, or Firm*—Jones, Day, Reavis & Pogue

[57] ABSTRACT

A sheet feeding apparatus capable of feeding corrugated cardboard sheet without the need for feed rolls which comprises a support for sheet having a feed end and a delivery end. The support further includes feed elements comprising at least one feed element driven at a variable speed and at least one feed element driven at a constant speed. The variable speed feed element transfers the sheet from the feed end to the constant speed feed element. The constant speed feed element transfers the sheet from the variable speed feed element to the delivery end. The variable speed feed element is driven by a variable speed generating mechanism which generates a motion cycle including a constant speed output segment which is equal to the constant speed of the constant speed feed element. The sheet feeding apparatus provides a smooth continuous, controlled transfer of the sheet from the feed end to the delivery end of the apparatus.

46 Claims, 4 Drawing Sheets

SINGLE FEED

DOUBLE FEED

SHEET FEEDING APPARATUS

This is a continuation of copending application Ser. No. 07/477,155 filed on Feb. 8, 1990, now U.S. Pat. No. 5,048,812 which is a continuation of abandoned U.S. Ser. No. 07/266,465, filed Nov. 3, 1988.

FIELD OF THE INVENTION

This invention relates to apparatus for feeding paperboard sheets, and particular corrugated paperboard sheets, to sheet-handling apparatus. This feeding apparatus can also be sued to feed solid fiber or non-corrugated sheets.

RELATED ART

Paperboard sheets, and particularly corrugated paperboard or cardboard sheets, are widely used in a variety of industries. Corrugated paperboard typically comprises a laminate of several layers of thin paperboard. The internal layer or layers of the paperboard are corrugated, i.e., comprised of paperboard which has parallel and alternating grooves therein. While these grooves lend strength to the cardboard without adding excess weight, they are very susceptible to being crushes when excess force is applied to the sheet.

Corrugated paperboard is manufactured in a papermaking plant and is then typically shipped as large flat sheets or "blanks" to box manufacturers who use the paperboard sheets to form boxes. The box manufacturer typically has machinery for printing desired information on the sheet and for forming the sheet into a flattened box ready for shipment to the customer, who then purchases the flattened boxes for later assembly and packaging of the customers product.

Sheet feeders are used in these industries where it is desirable to feed paperboard sheets to machinery for subsequent treatment thereof. Such sheet feeders are commonly used in the box-making industry, at the very beginning of the box manufacturing process, to feed corrugated paperboard sheets to an entire manufacturing line of machinery, which follows the sheet feeder, for treating the sheet. This machinery may comprise a variety of known sheet treatment machines for example a rotary die cutter or flexo-folder-gluer.

One common example of a manufacturing line for treating corrugated cardboard sheets includes a series of print and impression cylinders which provide printed matter on the sheet. These cylinders are commonly followed by a slotter which provides cuts in the sheet at which the sheet may be later folded for assembly into a box. The slotter may be followed by a gluer which provides adhesive on selected areas of the sheet so that when the sheet is later assembled into a box, selected areas of the sheet are adhered to one another.

The gluer may be followed by a folder which folds the peripheral ends of the sheet along the cuts created by the slotter so that ends of the sheet are positioned one on top of the other. Folding the sheet causes the areas of the sheet having adhesive thereon to be in register with one another. The folder may then stack the folded sheets on top of each other until a predetermined amount have been stacked. The stack of folded sheets is then bundled and shipped to the customer. Typically, the customer will assemble the folded sheet into a box, fill the box with its product and then sell the product contained in the box to the ultimate end user of the product.

Because the sheet feeder is but a small part at the very beginning of a much larger manufacturing line, it is essential that the sheet feeder transfer the sheet to the manufacturing line in precise sequence and at the same speed that the manufacturing line is processing the sheets. That is, each sheet must reach the manufacturing line at exactly the same point in the machine cycle of that line. When each sheet is not fed at exactly the same point in the cycle, the result is commonly refered to as misfeeding. Misfeeding causes the sheets to be treated in a non-uniform manner by the machinery. Sheets which are not treated uniformly end up as inferior "seconds" which may not be acceptable to the customer. Such seconds often have to be sold at a loss to the manufacturer. Losses to the manufacturer may ultimately be passed on to the customer in the form of higher prices for the treated sheets.

Sheet feeders of conventional design for timely feeding paperboard sheets to sheet-handling apparatus use vacuum assisted feeding elements such as suction cups, belts or wheels to transfer the sheet from a stack of sheets to a pair of heavy weight feed rolls or cylinders. The sheet is transferred by the feed rolls to the subsequent sheet-handling apparatus of the manufacturing line.

The feed rolls are arranged one on top of the other and are spaced slightly apart from each other. Typically, the feed rolls are spaced apart at a distance which is slightly smaller than the thickness of the sheet being fed. The small distance between the feed rolls through which the sheet passes is commonly refereed to in the art as the "nip". One feed roll is rotated in a clockwise direction while the other feed roll is rotated in a counter-clockwise direction. When the sheet reaches the nip it is grabbed between the oppositely rotating feed rolls. Because the nip is typically smaller than the thickness of the sheet, if the sheet is corrugated, the corrugations of the sheet may be crushed as it is grabbed by the feed rolls.

Examples of conventional sheet feeders which include feed rolls are disclosed in U.S. Pat. No. 4,494,745 to Ward Sr. et al., and U.S. Pat. No. 4,681,311 to Sardella. These conventional designs generate an intense vacuum force from underneath the sheet which pulls the sheet against the feed elements. In order for the feed rolls to grip the sheet and pull it from the control of the vacuum assisted feed elements, the nip between the feed rolls must be relatively small. Once the sheet has been gripped by the feed rolls it is then fed to the subsequent sheet-handling machinery.

It is an essential part of this conventional design to make the nip of the feed rolls relatively small to ensure that the sheet is under the control of the feed rolls before it is transferred to the subsequent machinery. If the sheet is not under control of the feed rolls the sheet may be not fed to the machinery in precise sequence. Therefore, it is common with these conventional designs to make the distance between the feed rolls so small that the corrugated layer of the sheet is crushed by the feed rolls as it is gripped by them.

As discussed above, crushing the corrugations is highly undesirable because the structural strength, integrity and appearance of the ultimate corrugated end product is considerably reduced. Inferior end products cause increased waste and excess cost to the manufacturer and ultimately the consumer, as well as cause consumer dissatisfaction.

Several sheet feeders have attempted to overcome the crushing problems associated with feed rolls. Although such feeders may avoid the problems associated with feed rolls, they suffer from their own problems and deficiencies. For example, these prior sheet feeders fail to provide a smooth, continuous, controlled transfer of the sheet.

One example of such prior sheet feeders is described in U.S. Pat. No. 4,363,478 to Tsukasaki. This feeder employs a kicker element which is reciprocated to engage the trailing edge of the bottommost sheet from a stack of sheets. The kicker element pushes the sheet onto a vacuum assisted conveyor belt which replaces conventional feed rolls. The speed at which the kicker advances toward the sheet is equal to the circumferential speed of the conveyor belt. Because the kicker element abruptly pushes the sheet onto the conveyor belt, this sheet feeder does not provide a smooth and continuous controlled transfer the sheet. Furthermore, this type of sheet feeder has been known to jam or misfeed if, among other reasons, a sheet is warped or the edge of the sheet is crushed or ragged. Such jams may cause significant production delays which increases manufacturing costs. As discussed previously, misfeeding is known to produce an inferior, non-uniform end product which is unacceptable to consumers.

Another example of a prior art sheet feeder which has attempted to overcome the crushing problems associated with feed rolls is described in U.S. Pat. No. 4,236,708 to Matsuo. The sheet feeder of this patent employs two sets of vacuum assisted conveyor belts to feed corrugated cardboard sheets to a die cutter. Each set of belts is arranged along the sheet feeder in a longitudinal direction to the direction of travel of the sheet. The first set of belts advances the sheet from rest up to lien speed of the subsequent sheet handling machinery. The first set of belts then feeds the sheet to the second set of belts which is traveling at line speed.

The Matsuo patent, although avoiding the problems associated with feed rolls, has several disadvantages. First, the speed between the two sets of belts is matched for only an instant during the period when the sheet is fed from the first set of belts tot he second. Therefore, for some finite time, the sheet is under the control of at least two belts which are not traveling at a matched speed. This unequal rate of speed between the two belts does not produce a smooth, continuous transfer of the sheet. Moreover, an unequal rate of speed can cause the belts to lose control of the sheet which would not be acceptable for heavyweight corrugated sheets. Lack of a smooth transfer and loss of control of the sheet by the feed belts can cause the sheet to be fed out of sequence to the subsequent sheet handling machinery. Feeding out of sequence or misfeeding, as discussed above, is known to result in an inferior, non-uniform end product.

Furthermore, the vacuum area of the Matsuo sheet feeder is not constant during the time when the sheet is in transition between the belt sets. As a result, the sheet may not remain in contact with the belts during the transfer. Naturally, this too can cause a loss of control of the sheet which can cause the sheet to be fed out of sequence to the subsequent sheet handling machinery, resulting in an inferior, non-uniform end product.

In general, the Matsuo sheet feeder can produce a discrete, abrupt transfer of the sheet from the first set of belts to the second set, which may result in the sheet being essentially "thrown" from one feeding element to the next. This throwing motion may ultimately result in a poor quality end product, since once the sheet has been uncontrollably fed to the second set of belts, it is likely to be misfed to the subsequent machinery as well.

Therefore, the need exists for a sheet-feeding apparatus that eliminates the crushing problems associated with feed rolls and provides a smooth, continuous, controlled transfer of a sheet to sheet handling machinery.

SUMMARY OF THE INVENTION

The present invention overcomes the problems and deficiencies discussed above by providing a sheet-feeding apparatus capable of feeding corrugated sheets without the need for feed rolls. The apparatus comprises a support for a sheet having a first plurality of feed elements driven at a variable speed and second plurality of feed elements driven at a constant speed. The feed elements are preferably arranged in transverse rows. The feed elements preferably comprise feed wheels.

The variable speed feed elements are driven by a variable-speed generating mechanism. The variable-speed generating mechanism generates a motion cycle which preferably comprises an acceleration segment, a constant-speed output segment, and a deceleration segment. The constant-speed output segment is substantially equal to the constant speed of the constant speed feed elements.

The variable-speed generating mechanism may comprise a driver element and a driven element, both having geared portions which intermesh to create the constant-speed output segment. The constant-speed output segment of the variable-speed generating mechanism may begin before the leading edge of the sheet contacts the variable-speed feed elements, and may be maintained until the trailing edge of the sheet has contacted the constant-speed feed element closest to the variable speed feed elements. When the leading edge of the sheet contacts one of the constant-speed feed elements adjacent the delivery end of the apparatus, the deceleration segment may begin. The deceleration segment may be created by the driver element including a roller which is received in a slot of the driven element.

An output gate may be provided above the variable speed feed elements to define a gap for limiting the number of sheets transferred at one time by the feed elements to the delivery end. A vacuum chamber may be provided adjacent the feed elements for creating a constant vacuum pressure which maintains the sheet in contact with the feed elements at all times during sheet transfer. The vacuum chamber may include vacuum partitions for allowing vacuum pressure to be provided adjacent selected feed elements.

A clearing mechanism may be provided adjacent the variable speed feed elements. The clearing mechanism may comprise a lowering mechanism, an actuator, and a clearing cam. Interaction between the clearing cam and actuator causes the lowering mechanism to move vertically and selectively prevent the sheet from contacting the feed elements.

The sheet feeding apparatus provides a smooth, continuous controlled transfer of a sheet, a corrugated sheet in particular, from one end of the feed apparatus to the other. Due to the absence of feed rolls, the sheet is fed without crushing the corrugations. The sheet remains under the control of a plurality of feed elements traveling at matched speed, which allows improved control of the sheet throughout sheet transfer. Maintaining the constant speed output segment of the variable speed feed elements until the sheet has been transferred to the control of the constant speed feed elements provides accurate feeding of the sheet to subsequent sheet-handling apparatus. As each successive feed element row assumes control of the leading edge of the sheet, a feed element row at the trailing edge of the sheet relinquishes control. This provides a smooth, continuous controlled transfer of the sheet as it is fed by the feeding apparatus.

These and other features and advantages of the invention will become apparent from the following description of a preferred embodiment of the invention.

BRIEF DESCRIPTION OF THE DRAWINGS

The foregoing and other objects, aspects, features and advantages of the present invention will be more fully appreciated as the same becomes better understood from the following detailed description of the present invention when considered in connection with the accompanying drawings, in which.

DETAILED DESCRIPTION OF THE PREFERRED EMBODIMENT

Figure 1:
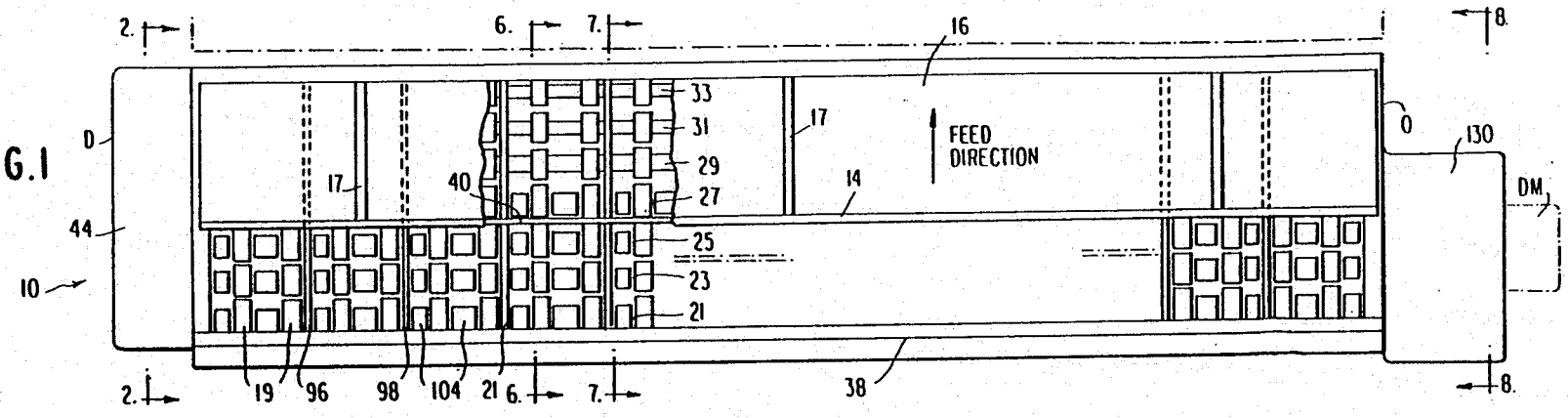
FIG. 1 shows a top plan view, with sections cut away, of a sheet feeder embodying the principles of the present invention.

Referring now to the drawings in which similar reference numerals have been used to refer to similar elements, and in particular to FIG. 1, the present invention comprises a sheet feeder, shown generally by reference numeral 10, for feeding a paperboard sheet from a stack of sheets. The sheet feeder 10 is designed to transfer an individual sheet to a variety of subsequent sheet handling machinery, designated by the dotted outline box labeled M. Machinery M may comprise for example: a die cutter; a slotter; a folder; a gluer; print and impression cylinders; as well as any combination of the same. The machinery M is driven at a continuous speed which is hereinafter referred to as the line speed, but does not form a part of the present invention. Furthermore, it is not essential to the present invention that sheet feeder 10 be as wide as machine M.

Sheet feeder 10 of the present invention comprises a series of feed wheels 19, a drive train located in housing 44, a vacuum mechanism located within wheel box 34 underneath feed wheels 91, and a clearing mechanism, a portion of which is located within wheel box 34, which cooperate to smoothly transfer a sheet to machine M. Each of the components will be discussed in turn in detail below.

Feed wheels 19 provide support for a sheet as it is transferred by sheet feeder 10, and preferably are comprises of high-friction urethane. However, other materials having a high coefficient of friction may be used as well. Feed wheels 19 are arranged in wheel box 34. Wheel box 34 has a feed end 38, a center portion 40, and a delivery end 42. The sides of wheel box 34 are shown generally in FIG. 1 as the operator side O and drive side D.

With continuing reference to FIG. 1, a plurality of feed wheels 19 are arranged along feed wheel shafts, 21, 23, 25, 27, 29, 31 and 33. Shafts 21, 23, 25, 27, 29, 31 and 33 are arranged in horizontal rows within wheel box 34 from feed end 38 to delivery end 42. Shafts 21, 23, 25, 27, 29, 31 and 33 extend across wheel box 34 from operator side O to the drive side D and are transverse to the direction of travel of a sheet from feed end 38 to delivery end 42. Feed wheels 19 are preferably arranged so that they do not contact one another. However, it is possible that shafts 21, 23, 25, 27, 29, 31 and 33 may be positioned so that wheels 19 of adjacent shafts are interleaved in order to conserve space by making the distance between feed end 38 and delivery end 42 shorter.

Figure 6:
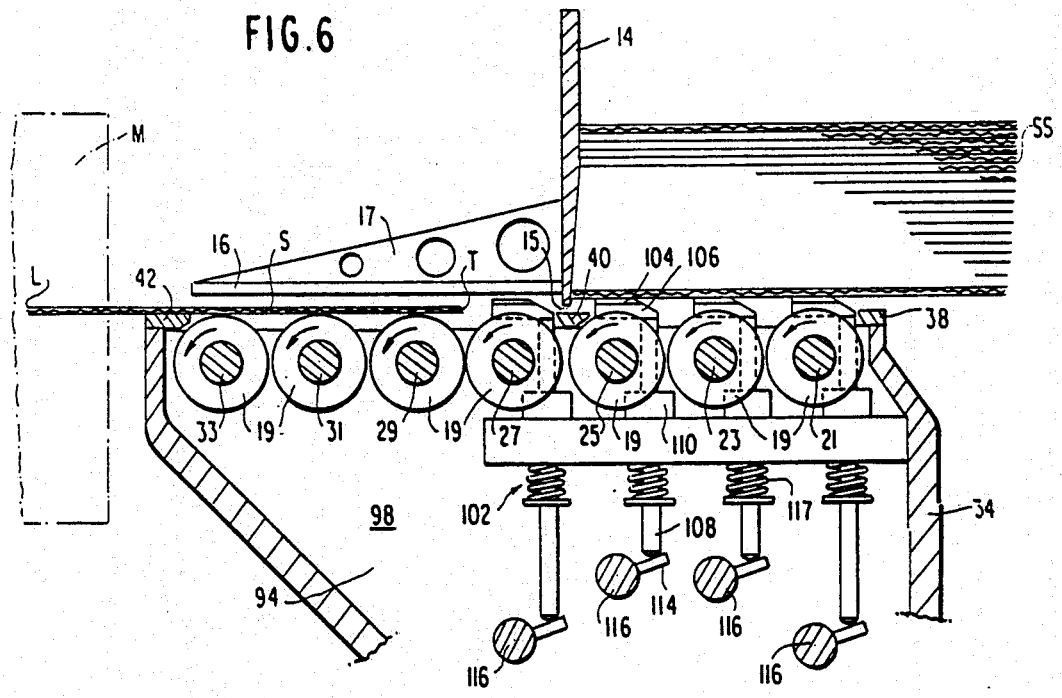
FIG. 6 is a cross section of the sheet feeder taken along line 6—6 of FIG. 1 with the clearing mechanism in the high position.

Referring now to FIG. 6, in which feeder 10 is shown just prior to transfer of a sheet S from stack SS to machine M, Sheet S is supported by feed wheels 19 on shafts 21, 23 and 25. A feed gate 14 is provided above center portion 40. Gate 14 is a rigid plate which extends from operator side O to drive side D of wheel box 34. Gate 14 acts as a front stop by preventing stack SS from moving toward delivery end 42. Sheet S has a leading edge L and a trailing edge T. A gap 15 is formed between the bottom of gate 14 and center portion 40. Gap 15 selectively allows only one sheet S at a time to pass from stack SS towards delivery end 42, and can be adjusted to accommodate for a variety of sheet thicknesses.

Feed wheels 19 are divided into two sets. The first set (plurality) comprises the transverse rows of shafts 21, 23, 25, and 27 in which the feed wheels 19 rotate at a variable speed. Shafts 21, 23 and 25 are disposed between feed end 38 and gate 14. Shaft 27 is disposed between gate 14 and delivery end 42. The second set (plurality) comprises the transverse rows of shafts 29, 31, and 33 in which the feed wheels 19 rotate at a constant speed. Shafts 29, 31 and 33 are disposed between shaft 27 and delivery end 42.

As will become apparent from the discussion below of the operation of sheet feeder 10, it is preferred that the constant speed at which feed wheels 19 of shafts 29, 31 and 33 are driven be equal to the line speed of machine M to ensure accurate feeding of sheet S to Machine M and therefore, uniform treatment of sheet S.

While individual feed wheels on shafts have been shown in the drawings, sheet feeder 10 could alternately comprise individual belts driven by pulleys, or any other known feed element means for transferring paperboard sheets. The belts, for example, may be arranged similar to the wheels shown in the drawings. That is, there could be seven transverse rows of individual belts extending from feed end 38 to delivery end 42 of feeder 10. Three transverse rows of belts driven at a variable speed may be provided between feed end 38 and gate 14. One transverse row of belts driven at a variable speed may be provided between gate 14 and deliver end 42. Three transverse rows of belts driven at a constant speed may be provided between the four belts driven at a variable speed and delivery end 42 of feeder 10.

Furthermore, while four rows of feed wheels 19 rotating at a variable speed and three rows of feed wheels 19 rotating at a constant speed have been shown in the figures, it is contemplated that sheet feeder 10 could comprise more or less than the number of rows shown. In addition, it is possible that sheet feeder 10 could employ a single row of feed elements rotating at variable speed and a single row of feed elements rotating at constant speed. Furthermore, while feed wheels having a continuous surface have been shown in the drawings, it is possible that feed wheels having a partially relieved surface, as in known in the art, could also be employed with the present invention.

Figure 2:
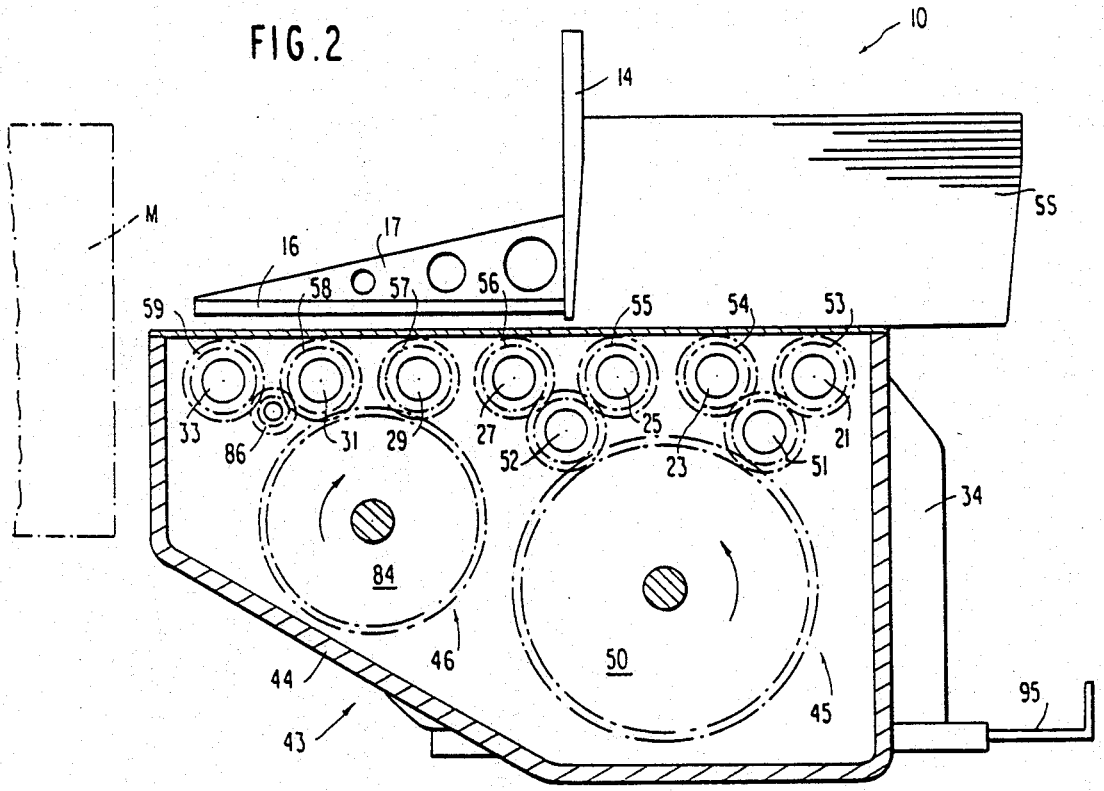
FIG. 2 is cross sections of the sheet feeder taken along line 2—2 in FIG. 1.

Referring now to FIG. 2, a drive train for rotating feed elements 19 of sheet feeder 10 is shown generally at 43. Drive train 43 is disposed within housing 45 preferably mounted at drive side D of wheel box 34. Drive train 43 comprises a variable-speed drive train shown generally at 45 and a constant-speed drive train shown generally at 46.

Variable-speed drive train 45 causes feed wheels 19 on shafts 21, 23, 25 and 27 to rotate, and comprises a variable-speed drive gear 50 rotating counterclockwise, a first variable-speed idler gear 51, and a second variable-speed idler gear 52. Both idler gears 51 and 52 are driven by the variable-speed drive gear 50. Additionally, variable-speed drive train 45 comprises variable-speed pinion gears 53, 54, 55, and 56 which are provided on feed element shafts 21, 23, 25 and 27 respectively. Gears 53 and 54 are driven by idler gear 51, while gears 55 and 56 are driven by idler gear 52. Rotation of pinion gears 53–56 by variable-speed idler gears 51 and 52 causes the variable-speed feed element shafts 21, 23, 25 and 27 to rotate, thereby causing feed wheels 19 located thereon to rotate. Contact between the rotating feed wheels 19 and sheet S causes sheet S to be transferred from feed end 38 toward delivery end 42.

With continued reference to FIG. 2, constant-speed drive train 46 comprises a constant-speed drive gear 84 which rotates clockwise, to drive constant-speed pinion gears 57 and 58 provided on shafts 29 and 30, respectively. Additionally, constant-speed gear train 46 comprises a constant-speed idler gear 86 which, driven by gear 58, drives constant-speed pinion gear 59 provided on shaft 31. Rotation of constant-speed pinion gears 57, 58 and 59 by drive gear 84 and idler gear 86 causes feed wheels 19 on shafts 29, 31 and 33 to rotate. Contact between the rotating feed wheels 19 and sheet S causes sheet S to be transferred from the feed wheels 19 of shafts 21, 23, 25 and 27 to delivery end 42 of feeder 10.

Constant-speed drive gear 84 may be driven independently of sheet feeder 10. However, as discussed above, it is preferable that feed wheels 19 on shafts 29, 31 and 33 are driven at the same line speed as machine M. Therefore, constant-speed drive gear 84 could be driven by machine M.

Figure 3:
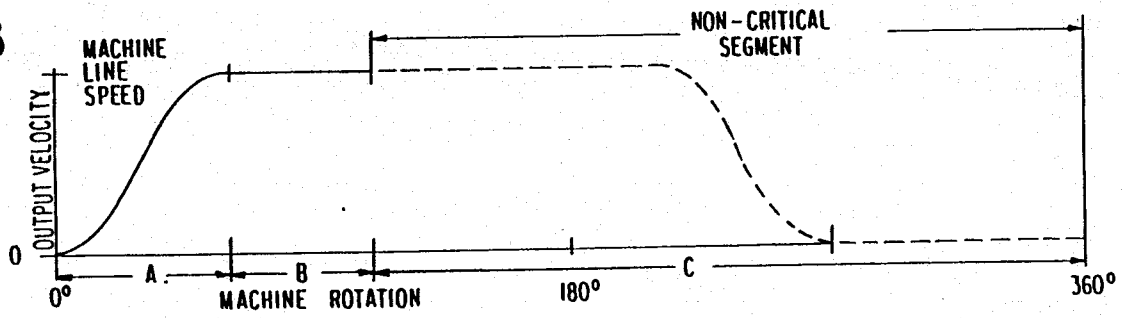
FIG. 3 is a diagram showing the relationship between output velocity and machine rotation during a single-feed operation of the present invention.
Figure 4:
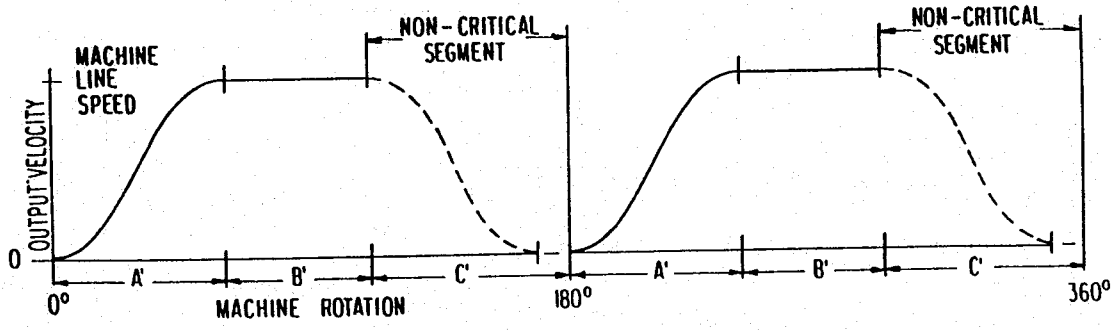
FIG. 4 is a diagram showing the relationship between output velocity and machine rotation during a double-feed operation of the present invention.

Variable-speed drive gear 50 is driven in the motion cycle shown in FIGS. 3 and 4. FIGS. 3 and 4 show the relationship between the output velocity or line speed of feed elements 19 on shafts 21, 23, 25, and 27 and machine rotation of sheet feeder 10. That is, it shows the line speed of the feed wheels 19 during the time it takes for sheet feeder 10 to go through one complete feed cycle (360°).

Referring now to FIG. 3, which shows a single feed operation where one sheet S is fed per machine cycle, the motion cycle of variable-speed drive train 45 is divided into three segments A, B, and C. The first is acceleration segment A. During acceleration segment A, the speed of the feed wheels 19 on shafts 21, 23, 25, and 27 accelerates from zero velocity to 100% velocity, which is equivalent to the line speed of machine M.

Segment B is the constant-speed output segment. During segment B, feed wheels 19 on shafts 21, 23, 25 and 27 are maintained at lien speed. Segment B continues approximately until lead edge L of sheet S has been transferred from feed elements 19 of shaft 25 toward delivery end 42 and as contacted the feed wheels 19 of shaft 33. At this point in the feed cycle, sheet S is under the control of feed wheels 19 on shafts 29, 31 and 33.

The third segment C is a non-critical segment during which the speed of feed wheels 19 on shafts 21, 23, 25 and 27 may increase or decrease without an effect on sheet S due to a clearing mechanism (FIGS. 6–10). The clearing mechanism maintains stack SS out of contact with feed wheels 19 on shafts 21, 23, 25 and 27 when it is desired that no sheet S be transferred form stack SS. The preferred non-critical segment C, shown in dotted liens in FIG. 3, is generated by a mechanism which is to be discussed in greater detail below. As shown in FIG. 3, the velocity at the end of segment C may, if desired, be zero.

FIG. 4 shows the relationship between output velocity of the feed elements 19 on shafts 21, 23, 25 and 27 and machine rotation (360°) of sheet feeder 10 during a double feed operation when two sheets are fed per machine rotation. That is, where the first sheet is fed when the machine rotation is at 0° and the second sheet is fed when the machine rotation is at 180°. During a double feed operation, the motion cycle goes through six segments A', B', C', A', B', and C'.

Segment A' is an acceleration segment. During segment A', feed wheels 19 on shafts 21, 23, 25 and 27 are accelerated from zero velocity to line speed. Segment A' is substantially identical to segment A of the single feed operation (FIG. 3). Segment B', the constant-speed output segment, is substantially identical to segment B of the single feed operation (FIG. 3). During segment B', feed wheels 19 on shafts 21, 23, 25 and 27 are maintained at 100% line speed, preferably until lead ledge L of sheet S has reached feed wheels 19 on shafts 29, 31 and 33. At this point in the feed cycle, sheet S is preferably under the control of feed element 19 on shafts 27, 31 and 33.

The third segment C' is the noncritical segment for the double feed operation. Similar to non-critical segment C (FIG. 3), the output velocity of feed wheels 19 on shafts 21, 23, 25 and 27 may increase or decrease without an effect on stack SS due to the clearing mechanism (FIGS. 6–10) which maintains stack SS out of contact with feed wheels 19 on shafts 21, 23, 25, and 27. Non-critical segment C' extends until 180° of a machine rotation, at which point in the feed cycle, a second acceleration segment A', identical to the first A' begins, followed by a second identical constant-speed output segment B', which is followed by a second non-critical segment C'. Both preferred non-critical segments C' are shown in dotted lines in FIG. 4.

Figure 5:
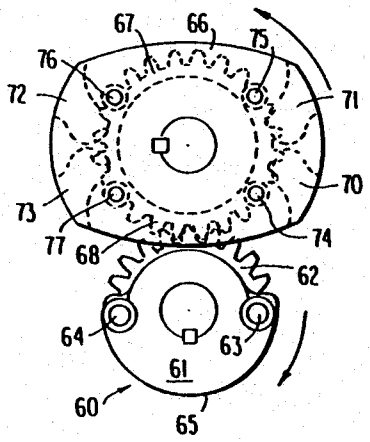
FIG. 5 is a side elevation of a variable speed generating mechanism for the sheet feeder of FIG. 1.

A variable-speed generating mechanism which is capable of generating the preferred motion cycles shown in FIG. 3 is shown generally at 60 in FIG. 5. This mechanism is available from Cyclo Index, a division of Leggett & Platt, Inc., Carthage, Mo. Mechanism 60, for performing the single feed operation of FIG. 3, is available as Part No. 6410-240-1/2. The preferred mechanism (not shown) for performing the double feed operation of FIG. 4 is available as part No. 6420-170-1/3.

Variable-speed generating mechanism 60 comprises a drier element 61 and a driven element 66 which cooperate to produce a variable-speed motion cycle. Drier element 61 comprises a geared portion 62; an acceleration roller 63; a deceleration roller 64; and a circumferential portion 65. Driven element 66 comprises two geared portions 67 and 68 each having teeth; four slots 70, 71, 72, and 73; and four rollers 74, 75, 76, and 77.

During segment A (FIG. 3) acceleration roller 63 is disposed within slot 70 and mechanism 60 functions similar to a conventional Geneva mechanism. As driver element 61 is rotated in a clockwise motion (by a constant driving force not shown), contact of roller 63 within slot 70 forces driven element 66 to rotate in a counterclockwise direction. Rotation of element 66 causes variable-speed gear train 45 (FIG. 2) to rotate which in turn causes variable-speed feed wheels 19 on shafts 21, 23, 25 and 27 to rotate. Rotation of feed wheels 19, as discussed above, causes sheet S to be transferred through sheet feeder 10.

FIG. 5 shows mechanism 60 during a portion of the constant-speed output segment B (FIG. 3), during which, the teeth of geared portion 62 of driver element 61 are intermeshing with the teeth of geared portion 68 of driven element 66. As driver element 61 continues to rotate clockwise, the teeth of geared portions 62 and 68 intermesh causing driven element 66 to rotate counterclockwise. This constant and continuous intermeshing of geared portions 62 and 68 causes variable-speed gear train 45 to rotate at a constant speed and thereby causes feed wheels 19 on shafts 21, 23, 25 and 27 to rotate at a constant speed.

Once the last tooth of each geared portion 62 and 68 have intermeshed, deceleration roller 64 on driver element 61 engages slot 77 and the deceleration segment begins (dotted line in FIG. 3). As driver 61 continued to rotate clockwise, the only contact between driver 61 and driven elements 66 is rollers 76 and 77 which roll along the surface of surface 65 of driver 61. Driven element 66 is in a dwell period in which it is maintained in a stationary position relative to driver element 61 by rollers 74 and 75. As shown in FIG. 3, deceleration of mechanism 60 occurs during the non-critical segment C. Although mechanism 60 provides a dwell period, it is not critical to the present invention that a dwell period be a part of the motion cycle.

As discussed above, variable-speed generating mechanism 60 shown in FIG. 5 can be used to rotate the variable-speed drive gear 50 (FIG. 2). While this is the preferred mechanism for generating the required motion cycle shown in FIG. 3, the present invention may be practiced with a variety of other conventional mechanisms which are capable of generating the desired variable speed motion cycle. Examples of such alternative variable-speed generating mechanisms which are capable of generating the required segments A and B include: a conventional indexing mechanism with a conventional differential; a conventional Geneva drive with a conventional differential; a five-bar dwell mechanism with a conventional differential; and a variable-speed motor.

Furthermore, although driven element 66 of mechanism 60 only achieves ~ a revolution per one revolution of driver 61, this ratio is not essential to the present invention. Alternative mechanisms which for example provide a 1:1 ratio or integer or fraction thereof would also be acceptable.

It should be understood that the preferred mechanism for driving the variable-speed drive gear 50 in a double feed operation would comprise a drive gear having two identical geared portions and rollers. Geared portions similar to portion 62 would, however, include fewer teeth than portion 62 shown in FIG. 5, and rollers 63 and 64 would be approximately 90° apart.

Figure 7:
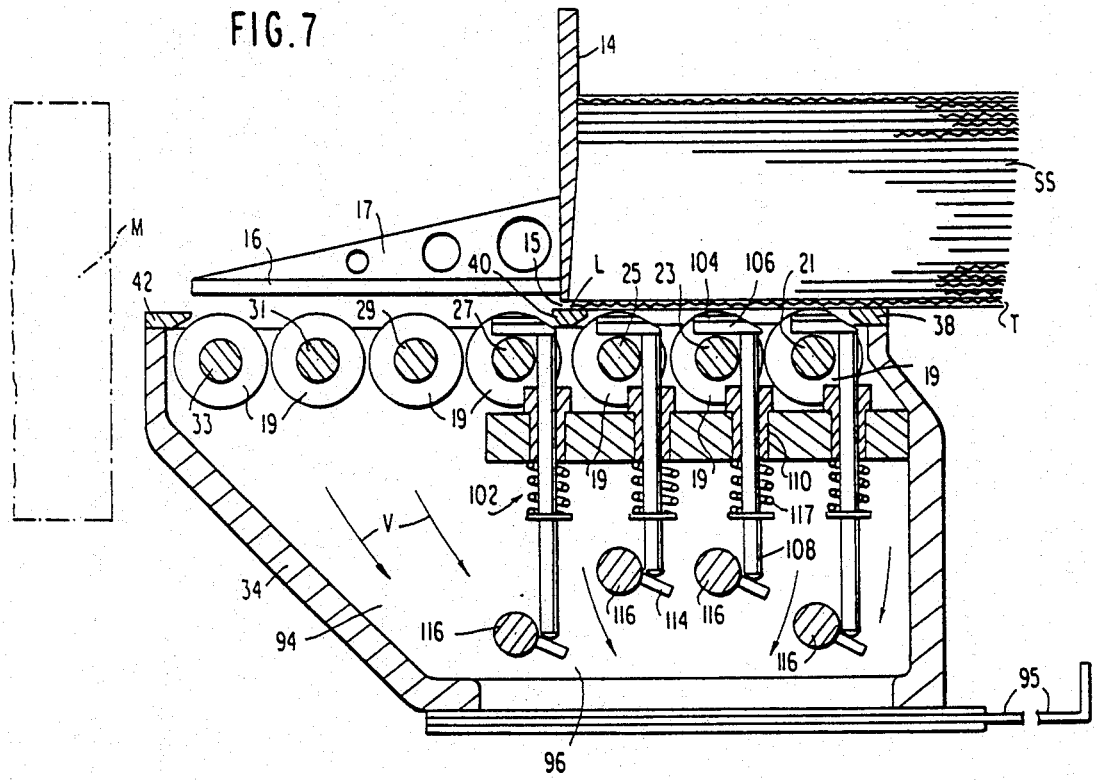
FIG. 7 is a cross section of the sheet feeder taken along line 7—7 of FIG. 1 with the clearing mechanism in the low position.

Referring now to FIG. 7, the vacuum mechanism will now be discussed. The vacuum mechanism maintains sheet S in constant contact with feed wheels 19 while sheet S is being transferred from feed end 38 to delivery end 42 of sheet feeder 10.

The vacuum mechanism more particularly comprises a vacuum chamber 94 located within wheel box 34 underneath feed wheels 19. Vacuum chamber 94 further includes alternating vacuum partitions 96 and bearing supports 98 (FIG. 1). Bearing supports 98 include bearing surfaces for supporting shafts 21, 23, 25, 27, 29, 31 and 33, and act as vacuum partitions.

Vacuum chamber 94 is connected at its bottom portion to a fan (not shown) which generates a constant negative vacuum pressure shown by arrows V in FIG. 7. Vacuum pressure V is applied to the underside of feed wheels 19 as they are supported across wheel box 34. Vacuum pressure V pulls sheet S against feed wheels 19 as sheet S is transferred along them. When a sheet narrower than the width of the wheel box 34, the width being defined by the distance between operator side O and the drive D side, si fed by sheet feeder 10, it is possible to close off vacuum pressure V to selected areas of vacuum chamber 94 which are not contacted by sheet S. This is possible by providing shut-off means 95 between portions of vacuum chamber 94, defined by partitions 96 and supports 98, and the fan. While a damper-like sliding plate has been shown in the figures as the preferred shut-off means, a valve, for example, would also be satisfactory.

A baffle 16 is provided above feed elements 19 on shafts 27, 29, 31 and 33 between gate 14 and delivery end 42. Baffle 16, which may be a horizontal flexible plate supported by vertical support 17, extends from operator side O to drive side D of sheet feeder 10. Baffle 16 is fixed at a height just above the height of sheet S as it passed thereunder. Baffle 16 serves to minimize air leakage into vacuum chamber 94 which might otherwise reduce the efficiency of the vacuum mechanism.

Although a single vacuum chamber 94 has been shown extending from feed end 38 to delivery end 42, individual vacuum chambers and fans could be provided for each row of feed wheels or the alternative feed elements discussed above. This would increase efficiency of the vacuum mechanism because any leakages of air associated with one chamber would not effect any of the other chambers. Furthermore, it is possible to provide one vacuum chamber for the rows of shafts 21, 23, 25 and 27 and a second vacuum chamber for the rows of shafts 29, 31, and 33; or to provide one vacuum chamber for the rows of shafts 21, 23 and 25 and a second vacuum chamber for the rows of shafts 27, 29, 31 and 33. Moreover, any alternative arrangement of vacuum chambers and fans which will achieve the desired result of minimizing air leakage may also be employed with the present invention.

FIGS. 6–10 show a clearing mechanism which is employed with sheet feeder 10 of the present invention. The clearing mechanism selectively prevents sheet S from contacting feed wheels 19 on shafts 21, 23, 25 and 27. The clearing mechanism comprises a lowering mechanism shown generally at 102, an actuator shown generally at 103, and a clearing cam 126. Lowering mechanism 102 is moved vertically by the interaction of actuator 103 and clearing cam 126, as will be discussed below.

One lowering mechanism 102 is shown provided adjacent each feed wheels 19 on each of shafts 21, 23, 25 and 27. Each lowering mechanism 102 includes a pad 104 which is provided on each side of each feed wheel 19. Pad 104 is disposed on the top of a block 106. A cylindrical clearing pad rod 108 is proved at the bottom of block 106 opposite pad 104. A linear bearing 110, disposed within wheel box 34, maintains the vertical movement of rod 108 and therefore of lowering mechanism 102. The end of rod 108, opposite block 106, is hemispherical.

Figure 8:
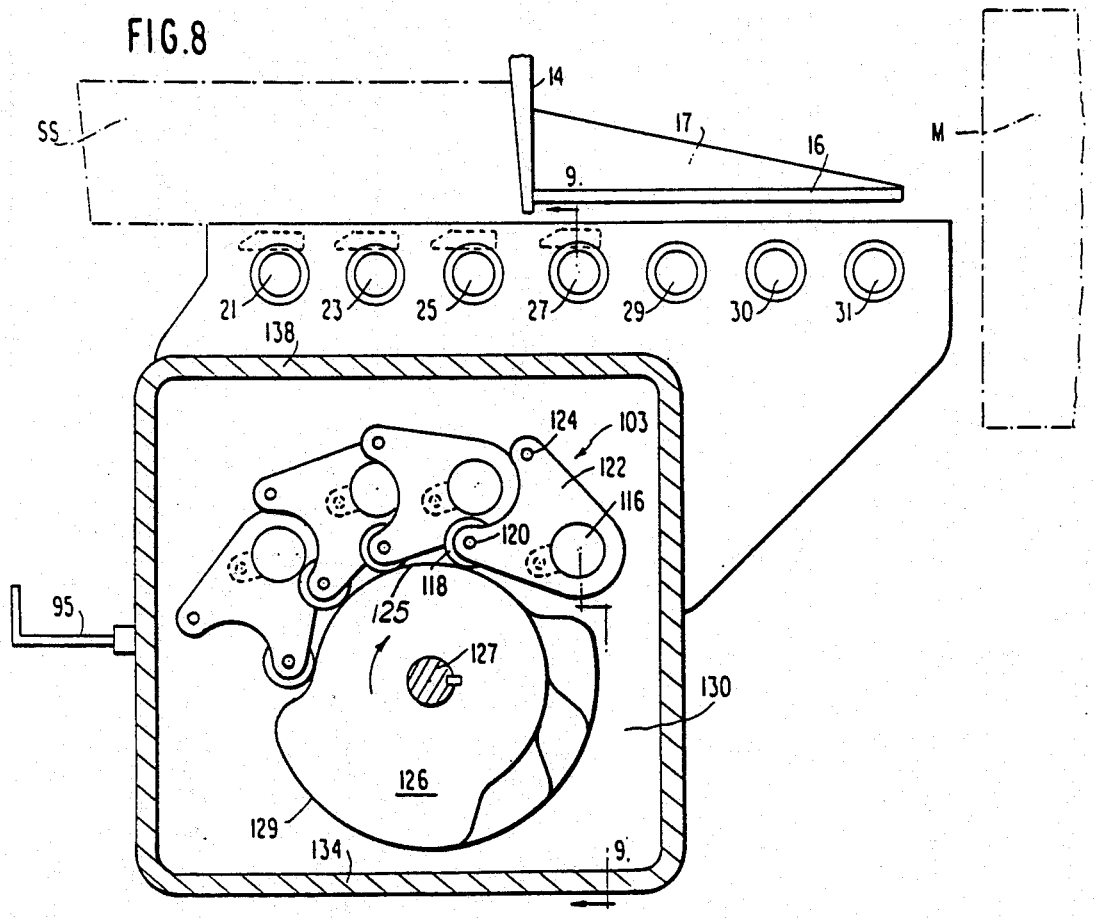
FIG. 8 is a cross section taken along line 8—8 in FIG. 1.

Actuator 103 comprises a push lever 114 (FIG. 7), actuating lever 122 and cam follower 118 (FIG. 8). One end of push lever 114 is in contact with the hemispherical end of rod 108. The other end of push lever 114 is rigidly fixed to a clearing shaft 116. Each clearing shaft 116 extends from housing 136 on operator side O to drive side D of feeder 10. Cam follower 118 is rotatably attached to actuating lever 122 by a cam follower pin 120.

Figure 10:
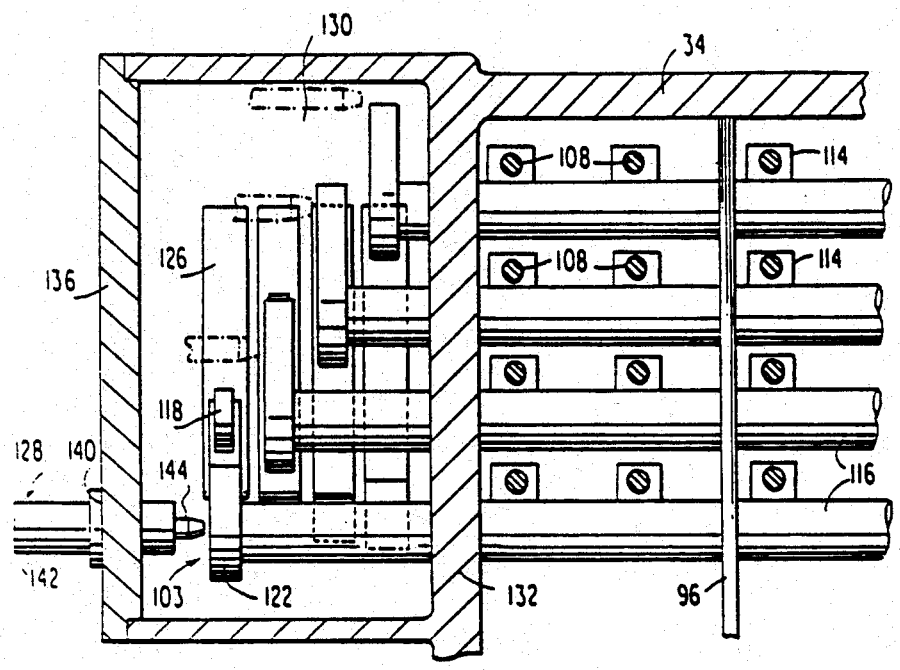
FIG. 10 is a cross section taken along line 10—10 in FIG. 9.
Figure 9:
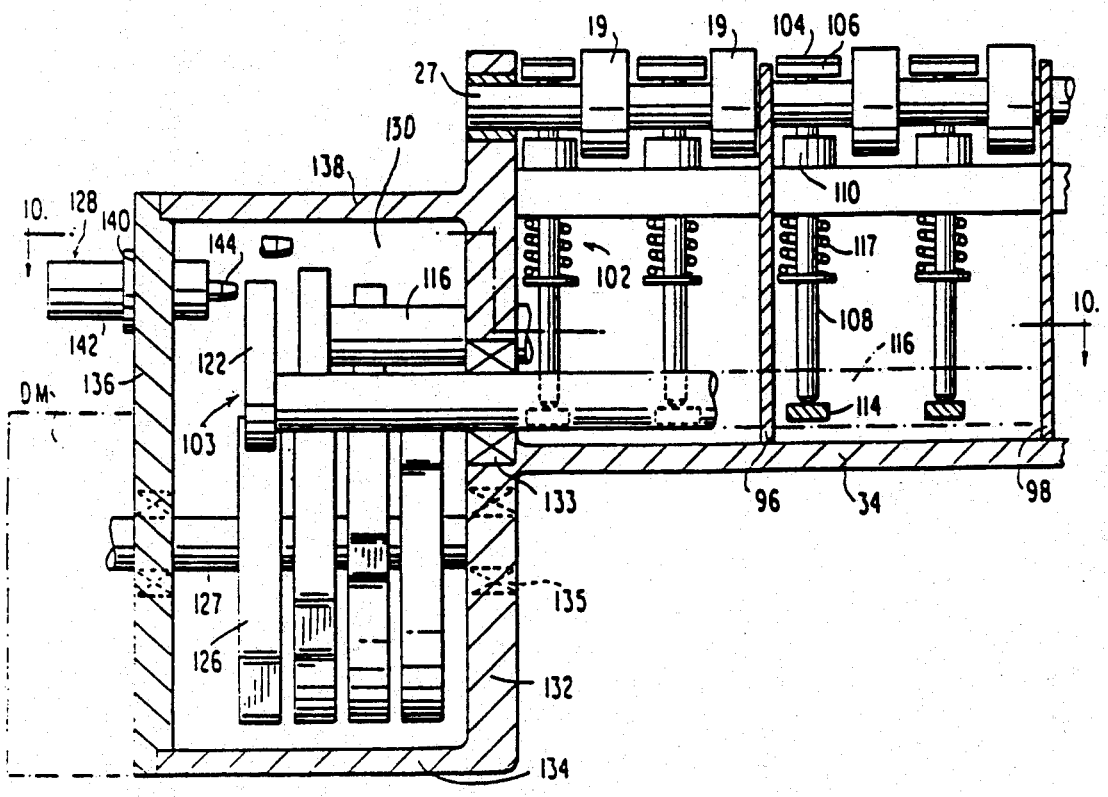
FIG. 9 is a cross section taken along line 9—9 in FIG. 8.

Referring now to FIGS. 8–10, clearing cams 126 are provided in housing 130. One cam 126 is provided for each row of feed wheels 19 on shafts 21, 23, 25 and 27. Cams 126 are disposed on cam shaft 127 which rotates at a constant angular speed preferably equal to the constant angular speed of driver 61 (FIG. 5). If an alternative variable-speed mechanism is selected to drive the variable-speed feed elements 19 of shafts 21, 23, 25 and 27, it is preferred that cams 126 be at a 1:1 ratio with the output element of the mechanism.

Each cam 126 has a profile including a relieved surface 125 and a non-relieved surface 129 (FIG. 8). Each cam follower 118 follows the profile of its associated clearing cam 126. A compression spring 117 is provided on rod 108 to provide a downward force on clearing shaft 116 to help ensure constant contact between each cam follower 118 and its associated clearing cam 126.

When cam followers 118 are in contact with the relieved surfaces 125 of clearing cam 126, lowering mechanisms 102 are in the down position during which time the bottommost sheets of stack SS is in contact with feed wheels 19 on shafts 21, 23, and 25 (FIG. 7). As cams 126 rotate and cams follower 118 contacts the non-relieved surface 129 of cams 126, shafts 116 pivots causing actuator 114 to pivot thereby moving rod 108 and therefore lowering mechanisms 102 vertically into the up position. During the up position, pads 104 are at a position higher than the top surface of feed wheels 19 on shafts 21, 23, 25 and 27, thereby preventing the bottommost sheet in stack SS from contacting feed wheels 19.

Referring now to FIGS. 9 and 10, actuators 103 and clearing cams 126 are disposed in clearing mechanism housing 130. Housing 130 preferably comprises the sheet feeder inner frame 132, a bottom plate 134, an end plate 136, and a top plate 138. Inner frame 132 provides a bearing surface 133 which supports clearing shafts 116, and a bearing surface 135 (shown in phantom in FIG. 9) which supports clearing cam shaft 127. A drive means DM for driving shaft 127 is shown in dotted outline in FIG. 9. Alternatively, shaft 127 may extend to drive side D of feeder 10 and may be driven by drive train 43. The end plate 136 of housing 103 also provides a bearing support 137 (shown in phantom) for clearing cam shaft 127.

Additionally, end plate 136 provides apertures 140 for supporting interrupter mechanisms shown generally at 128. One interrupter 128 is provided for each actuator 122. Each interrupter 128 acts as a latch by maintaining the clearing mechanism in the up position. Each interrupter 128 preferably comprises a double-acting air cylinder 142 which cooperates with an actuating lever 122. Air cylinder 142 includes an operator-selectable switch (now shown) which causes pressurized air supplied to air cylinder 142 to extend the tapered end 144 of air cylinder 142. When tapered end 144 is extended, ti is received within a tapered hole 124 on actuating lever 122 (FIG. 8). Tapered end 144 and tapered hole 124 are in alignment only when roller 118 is on surface 129 of cam 126; therefore, interrupter 128 should only be activated when roller 118 is on raised surface 129 of cams 126. The presence of tapered end 144 within tapered hole 124 slightly raises actuating lever 122 and prevents it from further pivoting which prevents rod 108 from moving vertically. When deactivation of interrupter 128 is desired, the operator-selectable switch is activated in the opposite direction causing tapered end 144 to retract from tapered hole 124. Preferably deactivation is accomplished when roller 118 is in contact with surface 129 of cam 126. Once deactivated, actuator 122 is allowed to pivot freely and therefore rod 108 is again allowed to move vertically.

Several lowering mechanisms 102 are provided along each shaft 21, 23, 25, and 27. An individual actuator 122, clearing cam 126 and interrupter 128 is provided for each shaft 21, 23, 25 and 27. Each clearing cam 126 has a cam profile which raises the lowering mechanisms for each row into the up position when trailing edge T of sheet S has been transferred to the next subsequent row of feed wheels 19. At the beginning of a feed cycle, the cams may lower all of the rods 108 in unison. However, it is also possible that rods 108 associated with feed elements 19 of shafts 21, 23 and 27 could lower in unison before rods 108 for shaft 29 are lowered. This would be useful if sheet S is particularly long.

Although the particular clearing mechanism shown in the Figures has been described with regard to the present invention, many other known clearing mechanisms could be used. Any conventional clearing mechanism which is capable of changing the relationship of stack SS and feed elements 19 would be suitable for incorporation with the present invention. For example, a clearing mechanism which lowers the feed wheels or elements, feed wheels having a relieved surface as discussed above; and an outer wheel rotatably mounted over the sheet support which blocks contact of the feed elements with the sheet could alternatively be used.

In operation of the preferred embodiment of sheet feeder 10 during a single feed operation of the present invention, stack SS is placed on the feed end of sheet feeder 10 and is supported by the clearing mechanism which is in the up position, preventing the bottommost sheet in stack SS from contacting feed wheels 19 on shafts 21, 23, 25 and 27. Gate 14 prevents stack SS from moving beyond center portion 40.

Feed wheels 19 on shafts 29, 31, and 33 are rotating at constant machine speed which is equal to the line speed of machine M. The vacuum mechanism is activated and provides constant vacuum pressure V in chamber 94 underneath the feed wheels 19. When it is desired to start feeding, the operator activates the switch on each interrupter 128 allowing rollers 118 to contact cams 126. The clearing mechanism begins to move towards the down position (FIG. 7) and variable-speed generating mechanism 60 begins acceleration segment A (FIG. 3). As sheet S contacts feed wheels 19 on shafts 21, 23, 25, and 27 they begin rotating counterclockwise in unison. Sheet S begins movement from feed end 38 towards delivery end 42.

Sheet S is now under the control of the feed wheels 19 on shafts 21, 23, and 25, rotating at identical or matched speed. Lead edge L of sheet S then passes under gate 14 and through gap 15. As lead edge L of sheet S contacts feed wheels 19 on shaft 27, lowering mechanism 102 for shaft 21 is raised to the up position. By the time sheet S is ready to be transferred from feed wheels 19 on shaft 27 to shaft 29, feed wheels 19 of shaft 27, and therefore sheet S, has reached 100% line speed. When lead edge L contacts feed wheels 19 on shaft 29, lowering mechanism 102 for shaft 29 is raised to the up position. When lead ledge L contacts feed wheels 19 on shaft 31, lowering mechanism 102 for shaft 25 is raised to the up position. Finally, when lead ledge L reaches feed wheels 19 on shaft 33, lowering mechanism 102 for shaft 27 is raised to the up position. Constant-speed output segment B has begun (FIG. 3) and is maintained until lead edge L of sheet S has contacted feed wheels 19 on shaft 33, or until sheet S is contacting the minimum number of rows of constant-speed feed wheels 19 necessary to control sheet S. In the preferred embodiment this minimum number is preferable three.

At this point in the feed cycle, all of the lowering mechanisms 102 are in the up position and sheet S is no longer contacting feed wheels 19 on shafts 21, 23, 25 and 27. The motion cycle of the variable-speed generating mechanism 60 is now in the non-critical segment C. Sheet S continues towards delivery end 42, under the control of feed elements 19 on shafts 29, 31, and 33, where sheet S is smoothly and continuously transferred to machine M while it is traveling at a 100% matched speed to the line speed of machine M.

The result is a smooth, continuous transfer of sheet S from one row of feed wheels 19 to the next row of feed wheels 19 where each successive row of feed wheels 19 which is contacting sheet S is traveling at the same speed as sheet S. This ensures that sheet S is controlled at all times throughout the feed cycle by preferably three rows of feed wheels 19 traveling at matched speed.

It should be understood that the foregoing disclosure relates only to presently preferred embodiments, and that it is intended to cover all changes and modifications of the invention herein chosen for the purpose of the disclosure which do not constitute departures form the spirit and scope of the invention as set forth in the appended claims.

What I claim is:

1. A sheet feeding apparatus for feeding a single sheet form a stack of corrugated sheets in a direction of travel from a feed end of said apparatus to a delivery end of said apparatus comprising:

a support for the sheet, said support extending from the feed end of the apparatus to the delivery end thereof and having feed elements;

said feed elements comprising a first plurality of feed elements and a second plurality of feed elements;

said first plurality of feed elements arranged in a first plurality of rows which extend transverse to the direction of travel of the sheet from the feed end to said second plurality of feed elements;

said second plurality of feed elements arranged in a second plurality of rows which extend from said first plurality of feed elements to the delivery end;

means for holding the sheet against said second plurality of feed elements while being fed thereby;

means for driving said first plurality of feed elements at a variable speed; and means for driving said second plurality of feed elements at constant speed.

2. A sheet feeding apparatus as set forth in claim 1, wherein said feed elements comprise wheels.

3. A sheet feeding apparatus as set forth in claim 1, wherein said first plurality of rows comprise at least three rows of feed elements.

4. A sheet feeding apparatus as set forth in claim 1, wherein said second plurality of rows comprise at least two rows of feed elements.

5. A sheet feeding apparatus as set forth in claim 1, wherein said sheet is supported by one of said first plurality of rows and one of said second plurality of rows when said sheet is transferred from said first plurality of rows to said second plurality of rows.

6. A sheet feeding apparatus as set forth in claim 1, wherein said means for driving said first plurality of feed elements is a variable speed generating mechanism.

7. A sheet feeding apparats as set forth in claim 6, wherein said variable speed generating mechanism generates a motion cycle comprising:

an acceleration segment; and a constant speed output segment.

8. A sheet feeding apparatus as set forth in claim 7, wherein said variable speed generating mechanism comprises:

a drier element having a geared portion; and a driven element having a geared portion, said constant speed output segment being generated when said driver element geared portion and said driven element geared portion intermesh with one another.

9. A sheet feeding apparatus as set forth in claim 6, wherein said variable speed generating mechanism generates a motion cycle comprising:

an acceleration segment;

a constant speed output segment; and a deceleration segment.

10. A sheet feeding apparatus as set forth in claim 9, wherein said variable speed generating mechanism further comprises:

a drier element having an acceleration roller; and a driven element having a slot;

said deceleration segment generated when said acceleration roller is received within said slot.

11. A sheet feeding apparatus as set forth in claim 9, wherein said sheet has a leading edge and a trailing edge; and said deceleration segment begins when said leading edge contacts one of said second plurality of rows adjacent said delivery end.

12. A sheet feeding apparatus as set forth in claim 6, wherein said variable speed generating mechanism generates a constant speed output segment which is substantially equal to the constant speed of said second plurality of feed elements.

13. A sheet feeding apparatus as set forth in claim 12, wherein said constant speed output segment of said variable speed generating mechanism is maintained at least until said sheet is contacting the minimum number of said second plurality of rows necessary to control said sheet.

14. A sheet feeding apparatus as set forth in claim 13, wherein said minimum number of rows necessary to control said sheet is at least three.

15. A sheet feeding apparatus as set forth in claim 12, wherein said sheet has a leading edge and a trailing edge; and said constant speed output segment begins before the leading edge of said sheet contacts said second plurality of feed elements.

16. A sheet feeding apparatus as set forth in claim 12, wherein said sheet has a leading and a trailing edge; and said constant speed output segment is maintained at least until said leading edge contacts one of said second plurality of feed elements adjacent said delivery end.

17. A sheet feeding apparatus as set forth in claim 1, further comprising:

a feed gate provided above said feed elements between said feed end and said delivery end, said feed gate and said support defining a gap for limiting the number of sheets transferred towards said delivery end at one time.

18. A sheet feeding apparatus as set forth in claim 17, wherein one row of said first plurality of rows is provided between said output gate and said delivery end.

19. A sheet feeding apparatus as set forth in claim 1, further comprising;

a vacuum provided adjacent said first plurality of feed elements, said vacuum creating a vacuum pressure for maintaining said sheet in contact with said first plurality of feed elements.

20. A sheet feeding apparatus as set forth in claim 19, said sheet support further comprising:

a wheel box, said feed elements being disposed in said wheel box; and a vacuum partition disposed within said wheel box, said vacuum partition allowing said vacuum pressure to be provided adjacent selected feed elements.

21. A sheet feeding apparatus as set forth in claim 1, further comprising:

a clearing mechanism provided adjacent said first plurality of feed elements, said clearing mechanism selectively preventing said sheet from contacting said first plurality of feed elements.

22. A sheet feeding apparatus as set forth in claim 21, wherein said clearing mechanism further comprises:

an individual clearing mechanism provided adjacent each of said first plurality of rows.

23. A sheet feeding apparatus as set forth in claim 22, wherein said clearing mechanism comprises:

a lowering mechanism capable of vertical movement;

an actuator in contact with said lowering mechanism, said actuator having a cam follower; and a clearing cam having a relieved surface, said cam following contacting said relieved surface thereby causing said lowering mechanism to move vertically to allow said sheet to contact said first plurality of feed elements.

24. A sheet feeding apparatus for feeding a single sheet from a stack of corrugated sheets in a direction of travel from a feed end of said apparatus to a delivery end of said apparatus, comprising:

a support for the sheet, said support extending from the feed end of the apparatus to the delivery end thereof and having feed elements;

said feed elements comprising a first feed element driven at a variable speed and a second feed element driven at a constant speed;

means for holding the sheet against said second feed element while being fed thereby; and a variable speed generating mechanism for driving said first feed element, said variable speed generating mechanism including a constant speed output segment.

25. A sheet feeding apparatus as set forth in claim 24, wherein said first feed element comprises a plurality of feed elements arranged in rows which extend transverse to the direction of travel of said sheet from said feed end toward said delivery end.

26. A sheet feeding apparatus as set forth in claim 25, further comprising:

a clearing mechanism adjacent said first feed element.

27. A sheet feeding apparatus as set forth in claim 26, wherein said clearing mechanism further comprises:

a lowering mechanism capable of vertical movement;

an actuator contacting said lowering mechanism, said actuator having a cam follower; and a clearing cam having a relieved surface;

said cam follower contacting said relieved surface thereby causing said lowering mechanism to move vertically to allow said sheet to contact said first feed element.

28. A sheet feed apparatus as set forth in claim 24, wherein said second feed element comprises a plurality of feed elements arranged in rows which extend transverse to the direction of travel of said sheet from said first feed elements toward said delivery end.

29. A sheet feeding apparatus as set forth in claim 28, wherein said constant speed output segment of said variable speed generating mechanism is maintained at least until said sheet is contacting the minimum number of rows of said second plurality of feed elements necessary to control said sheet.

30. A sheet feed apparatus as set forth in claim 29, wherein said minimum number of rows of feed elements necessary to control said sheet is at least three.

31. A sheet feeding apparatus as set forth in claim 24, further comprising:

a vacuum provided adjacent said feed elements, said vacuum creating a vacuum pressure for maintaining said sheet in contact with said feed elements.

32. A sheet feeding apparatus as set forth in claim 31, wherein said support further comprises:

a wheel box, said feed elements being disposed within said wheel box; and a vacuum partition disposed within said wheel box, said vacuum partition creating a vacuum chamber allowing said vacuum to be provided adjacent selected feed elements.

33. A sheet feeding apparatus as set forth in claim 24, wherein said variable speed generating mechanism generates a motion cycle further comprising:

an acceleration segment.

34. A sheet feeding apparatus as set forth in claim 33, wherein said variable speed generating mechanism generates a motion cycle further comprising:

a deceleration segment.

35. A sheet feeding apparatus as set forth in claim 24, wherein said first feed element comprises a first plurality of feed elements arranged in rows which extend transverse to the direction of travel of said sheet; and said second feed element comprises a second plurality of feed elements arranged in rows transverse extending to the direction of travel of said sheet, said first plurality of feed elements transferring said sheet from said feed end to said second plurality of feed elements.

36. A sheet feeding apparatus as set forth in claim 35, wherein when said sheet is transferred from said first plurality of feed elements to said second plurality of feed elements, said sheet is supported by both said first plurality of feed elements and said second plurality of feed elements.

37. A sheet feeding apparatus as set forth in claim 35, further comprising:

a feed gate provided above said first plurality of feed elements between said feed end sand said delivery end, said feed gate and said support defining a gap means for limiting the number of sheets transferred to said delivery end at one time.

38. A sheet feeding apparatus as set forth in claim 35, wherein one of said first plurality of feed elements is disposed between said output gate and said delivery end.

39. A sheet feeding apparatus as set forth in claim 24, wherein the speed of said constant speed output segment is substantially equal to the constant speed of said second feed element.

40. A sheet feeding apparatus as set forth in claim 24, wherein said feed elements comprise feed wheels.

41. A sheet feeding apparatus as set forth in claim 35, wherein said sheet has a leading and a trailing edge; and said constant speed output segment is maintained at least until said leading edge contacts one of said second plurality of feed element adjacent said delivery end.

42. A sheet feeding apparatus as set forth in claim 24, wherein said variable speed generating mechanism comprises:

a driver element having a geared portion; and a driven element having a geared portion, said constant speed output segment generated when said driver element geared portion and said driven element geared portion intermesh with each other.

43. A sheet feeding apparatus as set forth in claim 24, wherein said variable speed generating mechanism further comprises:

a driver element having an acceleration roller; and a driven element having a slot;

said deceleration generated by said variable speed generating mechanism being generated when said acceleration rollers is received with said slot.

44. A sheet feeding apparatus as set forth in claim 7, wherein during said acceleration segment, said first plurality of feed elements accelerate from zero velocity to said constant speed.

45. A sheet feeding apparatus as set forth in claim 9, wherein during said acceleration segment, said first plurality of feed elements accelerate from zero velocity to said constant speed.

46. A sheet feeding apparatus as set forth in claim 33, wherein during said acceleration segment, said first feed element accelerates from zero velocity to said constant speed.

* * * * *